US007083562B2

(12) United States Patent
Joos

(10) Patent No.: US 7,083,562 B2
(45) Date of Patent: Aug. 1, 2006

(54) GEARED FOLDING APPARATUS

(75) Inventor: Wolfgang Joos, Speyer (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/496,797

(22) PCT Filed: Dec. 2, 2002

(86) PCT No.: PCT/DE02/04403

§ 371 (c)(1),
(2), (4) Date: Jun. 7, 2004

(87) PCT Pub. No.: WO03/053832

PCT Pub. Date: Jul. 3, 2003

(65) Prior Publication Data

US 2005/0070416 A1 Mar. 31, 2005

(30) Foreign Application Priority Data

Dec. 7, 2001 (DE) ..... 101 60 101

(51) Int. Cl.
*B31F 1/10* (2006.01)

(52) U.S. Cl. ..... 493/427; 493/424; 493/432

(58) Field of Classification Search ..... 493/427, 493/471, 424, 432, 428
See application file for complete search history.

(56) References Cited

U.S. PATENT DOCUMENTS

| | | | | |
|---|---|---|---|---|
| 1,985,917 | A | 1/1935 | Crafts | |
| 3,608,889 | A * | 9/1971 | Woessner et al. | 493/360 |
| 4,279,410 | A * | 7/1981 | Bolza-Schunemann | 270/6 |
| 4,635,915 | A * | 1/1987 | Sato | 270/49 |
| 5,176,615 | A * | 1/1993 | Munsch | 493/427 |
| 5,417,642 | A * | 5/1995 | Boronka et al. | 493/425 |
| 5,443,437 | A * | 8/1995 | Mack | 493/359 |
| 5,547,452 | A * | 8/1996 | Kepert et al. | 493/427 |

FOREIGN PATENT DOCUMENTS

| | | |
|---|---|---|
| DE | 1 126 412 | 2/1967 |
| DE | 37 41 990 | 7/1988 |
| DE | 44 02 387 A1 | 8/1995 |
| EP | 0 222 152 B1 | 10/1986 |
| GB | 225 306 | 12/1924 |
| GB | 2 106 478 A | 9/1981 |
| GB | 2 285 970 A | 8/1995 |

* cited by examiner

*Primary Examiner*—Sameh H. Tawfik
(74) *Attorney, Agent, or Firm*—Jones Tullar & Cooper, PC

(57) ABSTRACT

A folding apparatus utilizes a primary drive motor, at least one cylinder that is driven for rotation by the primary drive motor, and a pair of folding rollers. The folding rollers can be driven for rotation by an auxiliary motor. The folding rollers can be coupled to the rotation of the cylinder by a differential drive that includes three drive take-off members. One of these is connected to each of the cylinder, the auxiliary motor, and the folding rollers.

12 Claims, 3 Drawing Sheets

GEARED FOLDING APPARATUS

FIELD OF THE INVENTION

The present invention is directed to a geared folding apparatus. The geared folding apparatus has at least one pair of folding rollers and a folding cylinder.

BACKGROUND OF THE INVENTION

Folding apparatuses are employed in the print industry, in particular in newspaper printing and are situated downstream of a web-fed printing press to transversely cut a continuously imprinted web, and to transversely fold the transversely cut imprinted web products. In the process, the individual products to be folded are transferred from a folding cylinder to a pair of folding rollers in such a way that a section of the product, in which the fold is to be made, enters a gap between two oppositely rotating folding rollers. The product is pulled into the gap by the rotation of the folding rollers and is folded in this way.

DE PS 11 26 412 and EP 0 222 152 B1 each disclose geared folding apparatuses.

U.S. Pat. No. 1,985,817 describes as geared folding apparatus in which the gear wheels, which are used for driving the folding rollers, can be dimensioned in such a way that either a slippage or a synchronous running of the folding rollers with respect to the folding cylinder can be achieved.

GB 225 306 A offers the suggestion of driving the folding rollers of a geared folder without a direct gear connection to the folding cylinder.

GB 2 106 478 A and DE 37 41 990 A1 disclose folding rollers which are driven by cardan shafts.

Folding rollers are known from DE 44 02 387 A1 which are driven by an electric motor.

SUMMARY OF THE INVENTION

The object of the present invention is directed to providing a geared folding apparatus.

In accordance with the present invention, this object is attained by the provision of a geared folding apparatus that has at least one pair of folding rollers and a folding cylinder. A ratio between the circumferential speeds of the folding cylinder and the folding rollers is changeable. The folding cylinder and the folding rollers may be connected by a differential gear and may be driven by at least one electric motor. An angle compensating coupling can be used to connect at least one of the rollers with a source of torque fixed in place on a frame.

In contrast to jaw folder apparatuses, geared folding apparatuses are more typically used for processing relatively thick products, which thick products cannot be securely held in the jaws of a jaw folding apparatus. Although it is possible to process such thick products in a geared folding apparatus, technical problems do also arise here because of the necessity of processing products of variable, not negligible thickness. At the entry to the gap between the folding rollers, the product to be processed must be dependably grasped by the folding rollers, drawn in and folded as sharply as possible. The folding rollers must be adjustable, with respect to each other, transversely to the plane of the gap. The folding rollers must thus be set in such a way that the products are dependably transferred into the gap and that no folding marks are formed on the product. This requirement of the folding roller having to be displaceable with respect to each other leads to difficulties in connection with the oil-tight seating of the folding rollers in the lateral plates of a frame of the folding apparatus.

It is possible, by use of the geared folding apparatus in accordance with the present invention, to easily process different products, such as broadsheets or straight sheets, collected or not collected, and of various thicknesses, and therefore also requiring various folding speeds. The circumferential speed of the folding rollers must be matched to these types of production, so that the products, when entering the gap between the folding rollers, are neither squashed, and are therefore not crumpled, nor pulled and therefore do not have scratch tracks from the folding rollers.

By operating an auxiliary motor at various rpm, it is possible to set different leads or circumferential speed ratios of the folding rollers, in respect to the folding cylinder, without it becoming necessary to make changes in the drive gears. The leads or speed ratios between the folding rollers and the folding cylinder can be varied without it being necessary to stop the folding apparatus, and possibly to stop a printing press arranged upstream of it, for this.

A control circuit for setting the rpm of the auxiliary motor, preferably for infinitely variable setting, is usefully assigned to the auxiliary motor.

In accordance with a preferred embodiment of the present invention, the geared folding apparatus also includes a differential gear with three drive members or power take-off members, one of which drive members, or power take-off members is connected with the cylinder, one of which is connected with the auxiliary motor and one of which is connected with the folding rollers. This differential gear, provides a coupling between the cylinder and the folding rollers which coupling makes it possible to drive the folding rollers substantially by use of the main drive motor which also drives the cylinders, and to effect a correction of the speed of the folding rollers of an order of magnitude of only a few percent by the use of the auxiliary motor.

The differential gear can be simply and compactly embodied as a harmonic drive gear. In this case, the drive member, which is connected with the auxiliary motor, is preferably the central shaft of the harmonic drive gear. This makes it possible to connect an electric motor, having rpm in the range between several hundred to several thousand rpm, directly to the differential gear as the auxiliary motor, without an additional reduction gear being required.

The folding rollers, which can be moved with respect to each other, are preferably driven via cardan shafts. By the use of these cardan shafts, it is possible to evenly and to rotatorily drive the folding rollers in spite of the mobility of these folding rollers, in relation to each other, without problems with oil tightness at the bearings of the folding rollers occurring.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENT

Figure 1:
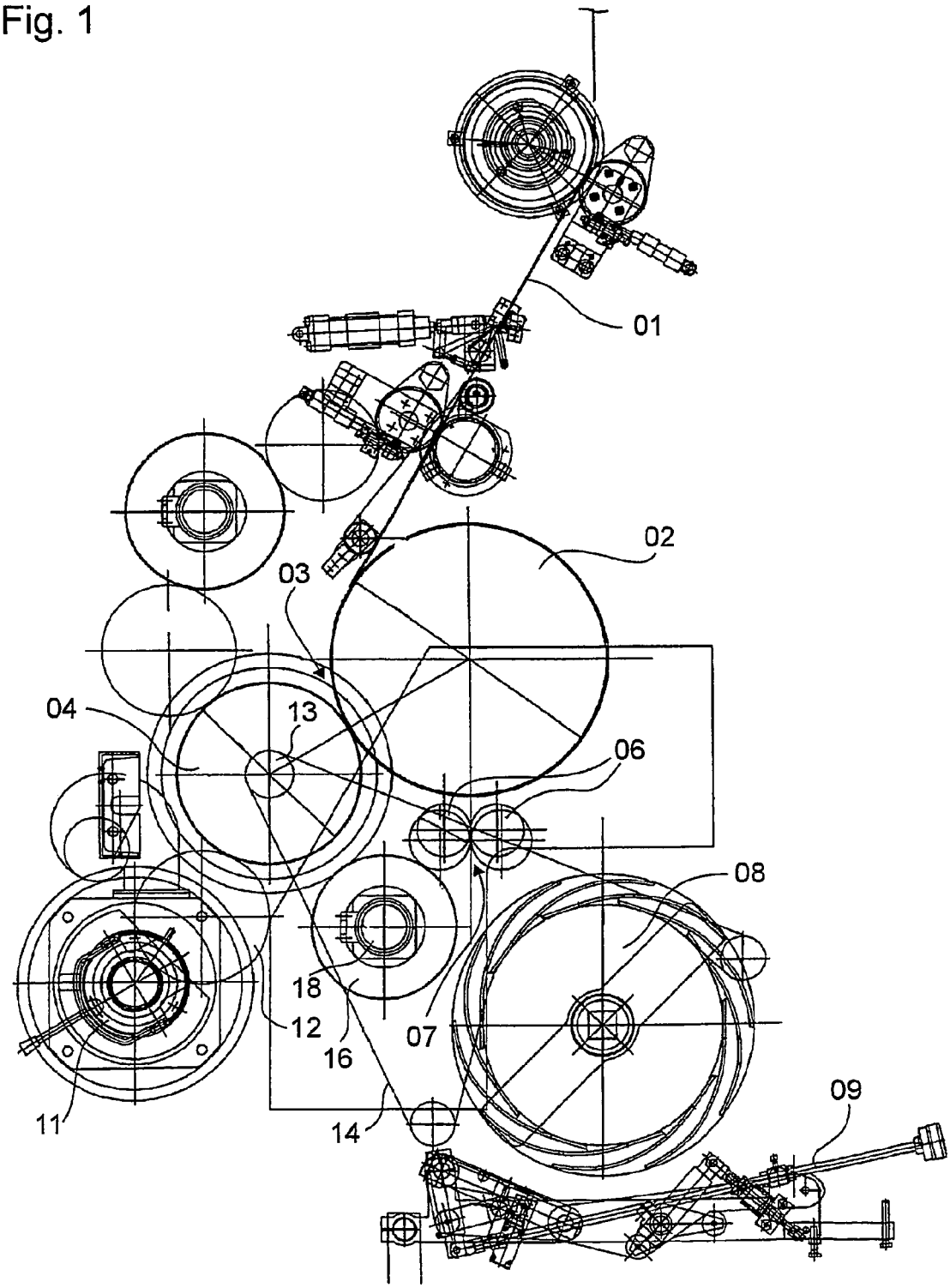
FIG. 1, a schematic side elevation view through a geared folding apparatus in accordance with the present invention, in FIG. 2, a cross-sectional view through the differential gear of the geared folding apparatus, and in FIG. 3, a schematic perspective view of portions of the gear of the folding apparatus in accordance with the present invention.

A folding apparatus, in accordance with the present invention, is comprised of a plurality of rollers and cylinders, which are maintained between two lateral frame plates, the most important of which rollers and cylinders are represented in section in FIG. 1. A strand or web 01 of material coming from a former, which is not specifically represented, enters the folding apparatus from above and is guided onto a folding cylinder 02. The folding cylinder 02 is rotatorily driven at the same circumferential speed as a cylinder 04, for example a cutting cylinder 04, together with which cutting cylinder 04, the folding cylinder 02 delimits a gap 03. As it passes through the gap 03, the strand 01 of material is divided into individual products by a cutter of the cutting cylinder 04. The leading edges of each of these products, which are in front, in the running direction of the strand 01 of material, are held by grippers, which are not specifically represented, of the folding cylinder 02, and are conveyed, in a counterclockwise direction, on the folding cylinder 02.

A pair of folding rollers 06 is arranged, so as to be horizontally displaceable with respect to each other, underneath the folding cylinder 02. When the center of a product, which is conveyed by the folding cylinder 02, after having been cut, is located above a folding gap 07, defined as the space between the folding rollers 06, the product is pushed off the folding cylinder 02 by a blade, which is not specifically represented, and which blade is moving out of the folding cylinder 02, and is introduced by that blade into the folding gap 07, into which gap 07 the product is drawn by the rotation of the folding rollers 06, and in this way, the product is folded in the center. A bucket wheel 08 is arranged underneath the folding rollers 06 in such a way that each of the folded products exiting from the folding gap 07 falls into buckets of the bucket wheel 08 and is deposited on a conveyor belt 09 by the rotating bucket wheel 08.

Figure 3:
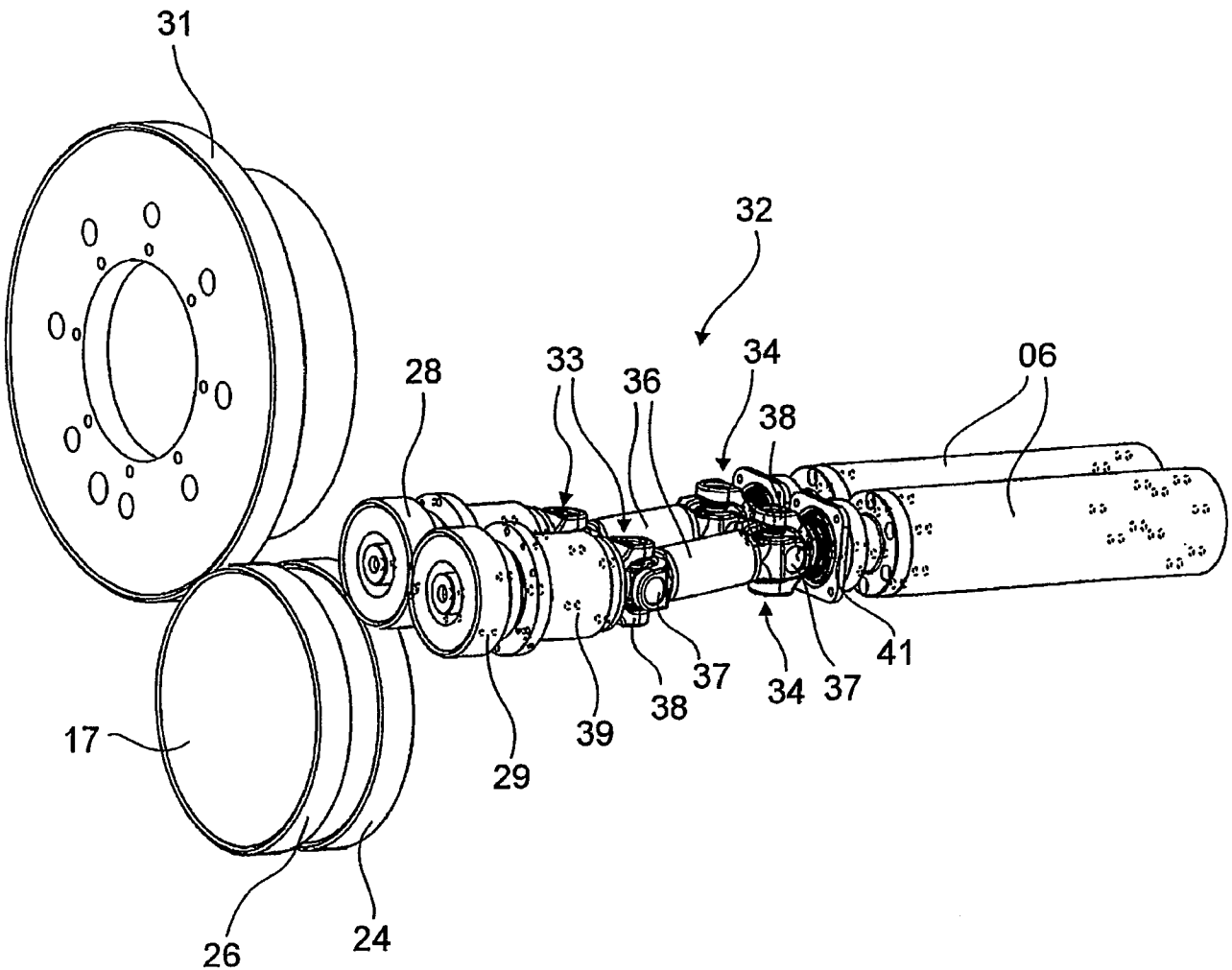

A main drive motor 11 provides the drive for effecting the rotating movement of the cutting cylinder 04 via a gear wheel 12 and a toothed spur wheel 31, which is seen in FIG. 3. A gear wheel of the folding cylinder 02 also meshes with a spur wheel of the cutting cylinder 04, by which, the rotation of the folding cylinder is driven. The rotation of the bucket wheel 08 is driven via a pulley 13, which is mounted on the shaft of the cutting cylinder 04, and by a belt 14.

Figure 2:
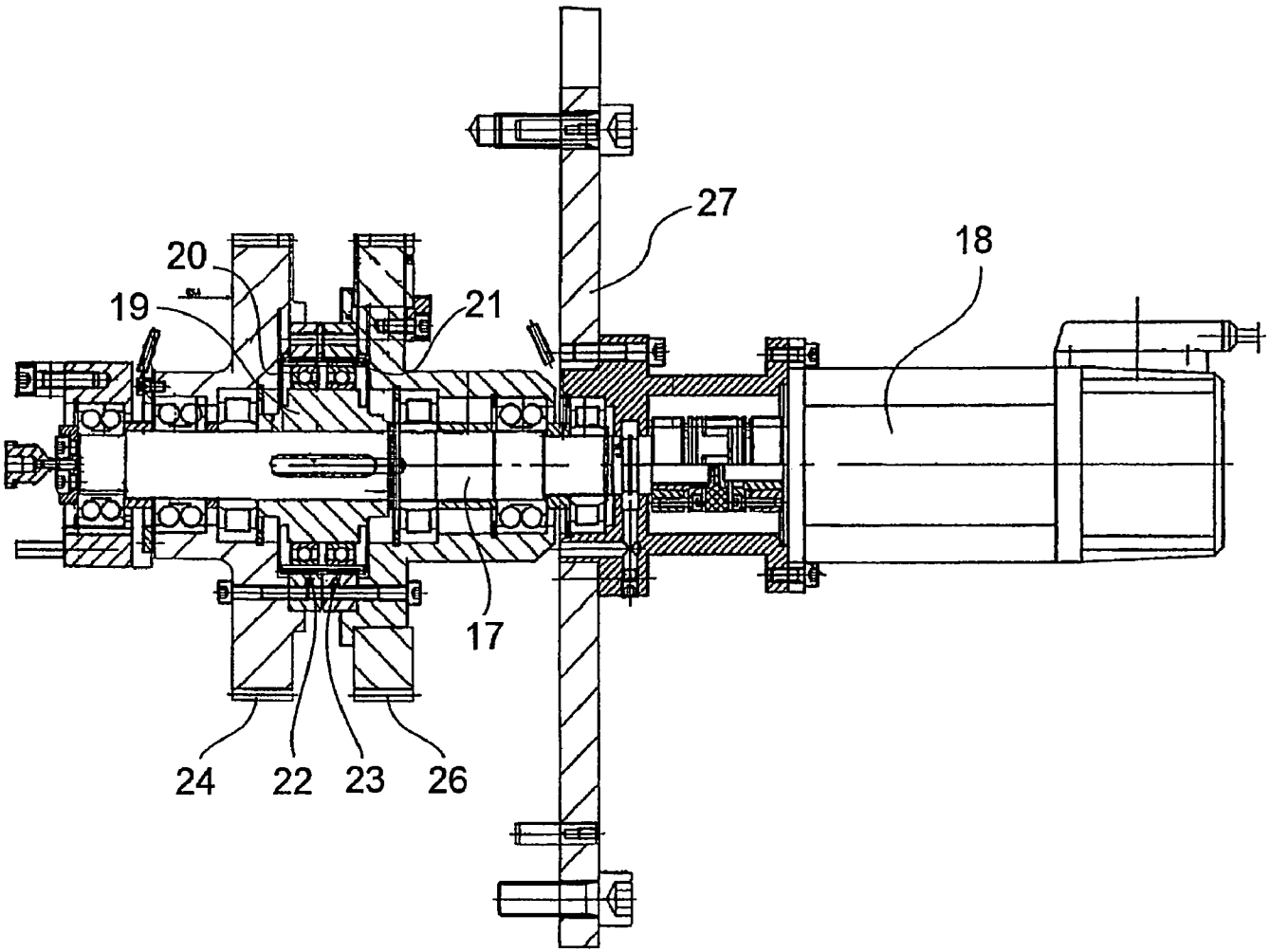

As represented in greater detail in FIGS. 2 and 3, the rotation of the folding rollers 06 is driven via a differential gear 16 with three drive or power take-off members.

The differential gear 16, which is shown in a sectional view in FIG. 2, is a so-called harmonic drive gear 16, or HD gear 16.

A central shaft 17 of the HD gear 16 is directly connected to the power take-off shaft of an auxiliary motor 18. This central shaft 17 has a section of an elliptical cross section 19, also called a rotor 19, onto which rotor, and separated by elliptically deformed bearings 20 corresponding to the shape of the rotor 19, for example roller bearings 20, a flexible ring 21 is pulled, which flexible ring 21 corresponds to the outer contours of the roller bearings 20 and has external teeth. This externally toothed ring 21, also called a flexspline, meshes with two sleeves 22, 23, which are arranged axially next to each other, have internal teeth and are each connected, fixed against relative rotation, with gear wheels 24, 26. The elliptically shaped, flexible ring 21 meshes with the internal teeth of the sleeves 22, 23 at respectively two opposite locations on the longer axis of the ellipse, and the number of its teeth is less, by a small, even number, than the number of teeth of the sleeves 22, 23.

As depicted in the perspective view in FIG. 3, the gear wheel 24, which is remote from the lateral plate of the frame 27, meshes with a first drive gear wheel 28 of the folding rollers 06, which first drive gear wheel 28 is rotatably seated, fixed in place on the lateral plate 27. The first drive gear wheel 28, in turn, meshes with a second drive gear wheel 29 of the folding rollers 06. The number of teeth of the first and second drive gear wheels 28, 29, respectively are identical, so that both rotate in opposite directions at the same speed.

The gear wheel 26 of the differential gear 16, which is located closer to the lateral plate 27, meshes with the above-mentioned spur wheel 31 of the cutting cylinder 04. Therefore, the gear wheel 26 represents a first drive member of the differential gear 16, and the gear wheel 24 constitutes a power take-off member.

If the central shaft 17 of the differential gear 16 does not rotate, a rotation of the gear wheel 26, which is driven by the spur wheel 31, is transmitted to the flexible ring or flexspline 21, which then rotates at a number of rotations which is greater, by the ratio of the number of teeth of the sleeve 22 and the ring 21, than that of the gear wheel 24. A corresponding gearing takes place between the ring 21 and the sleeve 23 so that, if the number of teeth of the sleeves 22, 23 are identical, the gear wheels 24, 26 rotate at the same speed. The number of teeth of the spur wheel 31, the gear wheels 26, 24 of the differential gear 16, and the drive gear wheels 28, 29 of the folding rollers 06 have been selected in such a way that in this operative mode, with the shaft 17 stationary, a lead or a ratio of the circumferential speed of the folding rollers 06 of approximately 14%, with respect to the folding cylinder 02, results.

A control circuit, which is not specifically represented, is assigned to the auxiliary motor 18, and which control circuit provides auxiliary motor 18 with electrical energy in such a way that auxiliary motor 18 rotates frontwards or backwards at a speed which can be set by the use of this control circuit. Such control circuits are generally known and thus do not need to be described here in detail.

The rotation of the shaft 17, driven by the auxiliary motor 18, is additively superimposed on the rotation driven from the spur wheel 31 at a reduction ratio corresponding to the ratio between the number of teeth of the ring 21 and the difference in the number of teeth of the ring 21 and the sleeves 22 or 23. This reduction, caused by the construction of the HD gear 16, allows the coupling of the auxiliary motor 18 directly with the shaft 17, without the need for the interposition of a reduction gear, and allows the apparatus to achieve a correction of the rotational speed of the folding rollers 06 of an order of magnitude of, for example only ±2% in respect to its speed with a stationary shaft 17 by varying the rpm of the auxiliary motor 18 over its entire usable rpm range, which can include, for example, ±3,500 rpm. This means that the lead or speed ratio between the folding rollers 06 and the folding cylinder 02 can be set at intervals between 12% to 16%. Such a correction interval is sufficient for use in matching the speed of the folding rollers 06 to the processing of products of variable thickness. A very exact regulation is possible within this range.

In place of an auxiliary motor 18, which can be controllably driven in two directions of rotation, it is also possible to employ an auxiliary motor with a single direction of rotation. In this case, the gearing between the cutting cylinder 04 and the folding rollers 06, while the shaft 17 is stationary, has been selected in such a way that a lead at a lower, or an upper, edge of a desired value range, i.e. for example 12% or 16% results, and a correction of the lead of up to +4% or −4% is achieved, by the appropriate setting of the rpm of the auxiliary motor.

As FIG. 3 shows, the rotation of the drive gear wheels 28, 29 is transmitted to the folding rollers 06 via respective angle-compensating couplings 32, for example cardan shafts 32. Each of these angle compensating couplings 32 comprises two spaced joints 33, 34, for example universal joints 33, 34, and a connecting rod 36, which connects a respective head 37 of each of the universal joints 33, 34 with each other. The other head 38 of the joint 33, 34 is seated at the end of a shaft, whose other end supports the drive gear wheel 28 or 29 and is maintained in a bearing bushing 39, which is fixedly connected with the lateral plate 27, in a manner which is not specifically represented.

The second head 38 of the universal joint 34 is rigidly connected, via a shaft, with one of the folding rollers 06. This shaft extends through a first bearing bushing 41 that is arranged between the universal joint 34 and the folding roller 06, and a second bearing bushing, which is not specifically represented, at the opposite end of the folding roller 06. Both bearing bushings can be displaced transversely in respect to the plane of the gap 07 between the two folding rollers 06, for example by the use of a rail guidance, or by being mounted on a pivot arm.

A defined freedom of movement of the folding rollers 06 transversely, with respect to the plane of the gap 07, already results from a play of the heads 37, 38 in the linear direction. The freedom of movement can be increased if each of the connecting rods 36 has a telescopically extensible structure, with an outer sleeve rigidly connected with one of the heads 37, 38, and with an inner shaft, rigidly connected with the respectively other head 38 or 37, and guided, fixed against relative rotation, and displaceably in the outer sleeve.

Instead of the auxiliary motor 18, both of the folding rollers 06 can be mechanically connected and can be driven by their own electric motors, in a configuration not shown, which electric motors are independent of the main drive and are, in particular, regulated as to rpm and/or position. Also, an rpm-and/or positionally regulated electric motor can be provided for each folding roller 06.

While preferred embodiments of a geared folding apparatus, in accordance with the present invention, have been set forth fully and completely hereinabove, it will be apparent to one of skill in the art that various changes in, for example, the overall sizes of the cylinders, the specific structure of the printing press, and the like could be made without departing from the true spirit and scope of the present invention, which is accordingly to be limited only by the appended claims.

What is claimed is:

1. A geared folding apparatus comprising:

at least one pair of folding rollers;

means for rotating said at least one pair of folding rollers at a folding roller circumferential speed;

a folding cylinder cooperating with said folding rollers;

means for rotating said folding cylinder at a folding cylinder circumferential speed; and means for infinitely adjusting a ratio between said folding roller circumferential speed and said folding cylinder circumferential speed.

2. The geared folding apparatus of claim 1 wherein said folding rollers are driven mechanically independent of said folding cylinder.

3. The geared folding apparatus of claim 1 wherein said folding rollers and said folding cylinder are mechanically coupled.

4. The geared folding apparatus of claim 1 further including a lead of said circumferential speed of said folding rollers with respect to said circumferential speed of said folding cylinder, said lead being between 12 and 14%.

5. The geared folding apparatus of claim 1 further including an additional cylinder and a main drive motor for said additional cylinder.

6. The geared folding apparatus of claim 5 wherein said additional cylinder is a cutting cylinder.

7. The geared folding apparatus of claim 6 wherein said folding cylinder and said cutting cylinder define a gap.

8. The geared folding apparatus of claim 5 wherein said main drive motor drives said geared folding apparatus.

9. The geared folding apparatus of claim 1 further wherein said at least one pair of folding rollers are mechanically coupled and further including an electric motor for driving said at least one pair of coupled folding rollers.

10. The geared folding apparatus of claim 1 further including a separate electric motor for driving each of said folding rollers in said at least one pair of folding rollers.

11. The geared folding apparatus of claim 1 wherein said folding cylinder includes a folding blade.

12. The geared folding apparatus of claim 1 further including axes of rotation for each of said at least one pair of folding rollers and said folding cylinder, said axes of rotation being parallel.

* * * * *